US005503566A

United States Patent [19]

Wang

[11] Patent Number: 5,503,566

[45] Date of Patent: Apr. 2, 1996

[54] COMPUTER NETWORK DISTRIBUTION SYSTEM

[76] Inventor: Tsan C. Wang, 1F., No. 13, Lane 312, Chung Cheng Rd., Hsin Tien, Taipei Hsien, Taiwan

[21] Appl. No.: 318,253

[22] Filed: Oct. 5, 1994

[51] Int. Cl.[6] ..... H01R 29/00

[52] U.S. Cl. ..... 439/188

[58] Field of Search ..... 439/188, 579, 439/502

[56] References Cited

U.S. PATENT DOCUMENTS 5,219,297 6/1993 Stein et al. ..... 439/188 OR
5,233,501 8/1993 Allen et al. ..... 439/188 X
5,246,378 9/1993 Seiceanu ..... 439/188 OR
5,348,491 9/1994 Louwagie et al. ..... 439/579 X

*Primary Examiner*—P. Austin Bradley
*Assistant Examiner*—Daniel Wittels
*Attorney, Agent, or Firm*—Bacon & Thomas

[57] ABSTRACT

A computer network distribution system including a plurality of network couplers fixedly installed in a building, and dual cables for connecting the network couplers to personal computers, each network coupler including two coaxial cable connectors for connecting a respective personal computer to the network system by a dual cable. A network junction box is provided having a plurality of network couplers for connecting additional personal computers to a computer network system being fixed in a building.

2 Claims, 13 Drawing Sheets

COMPUTER NETWORK DISTRIBUTION SYSTEM

BACKGROUND OF THE INVENTION

The present invent ion relates to it computer network distribution system for the distribution of network signal to the personal computers coupled thereto.

Various coupling devices have been disclosed for use to distribute computer network signal to personal computers. Exemplars of these devices as shown in U.S. Pat. No. 4,437,722 issued to Biarchi; No. 4,588,249 issued to Blichasz et. al.; No. 4,687,447 issued to Birch et. al.: No. 5,076,799 issued to Arai el. al.; No. 5,011,428 issued to Heng; and No. 5,076,799 issued to Virgo. These coupling devices can only connect one single personal computer to a computer network system.

U.S. patent application No. 08/189,760, filed by the present inventor on Feb. 1, 1994, discloses an auto termination type electrical connector (see FIG. 1). Two auto termination type electrical connectors can be arranged in parallel to form a network coupling device, as shown in FIG. 2, to connect a personal computer to a computer network system by a coaxial cable and a BNC coaxial cable connector. This network coupling device can only connect one personal computer to the computer network system. This network coupling device is to be fixed in a building at a desired location. If there are several personal computers to be installed in the selected location and connected to the computer network system, the connection between the personal computers and the computer network system cannot be done by the network coupling device.

SUMMARY OF THE INVENTION

The present invention eliminates the aforesaid problems. One object of the present invention is to provide a computer network distribution system which comprises a plurality of network couplers and a plurality of dual cables for connecting personal computers to a computer network system, wherein the network coupler has two coaxial cable connectors, and each coaxial cable connector can be connected to a respective personal computer by one dual cable.

It is another object of the present invention to provide mobile network couplers for connecting personal computers to a computer network system at desired locations.

It is still another object of the present invention to provide a network coupler for a computer network system which permits computer network signal to be transmitted from one network coupler to another at any working status.

DETAILED DESCRIPTION OF THE PREFERRED EMBODIMENTS

Figure 1:
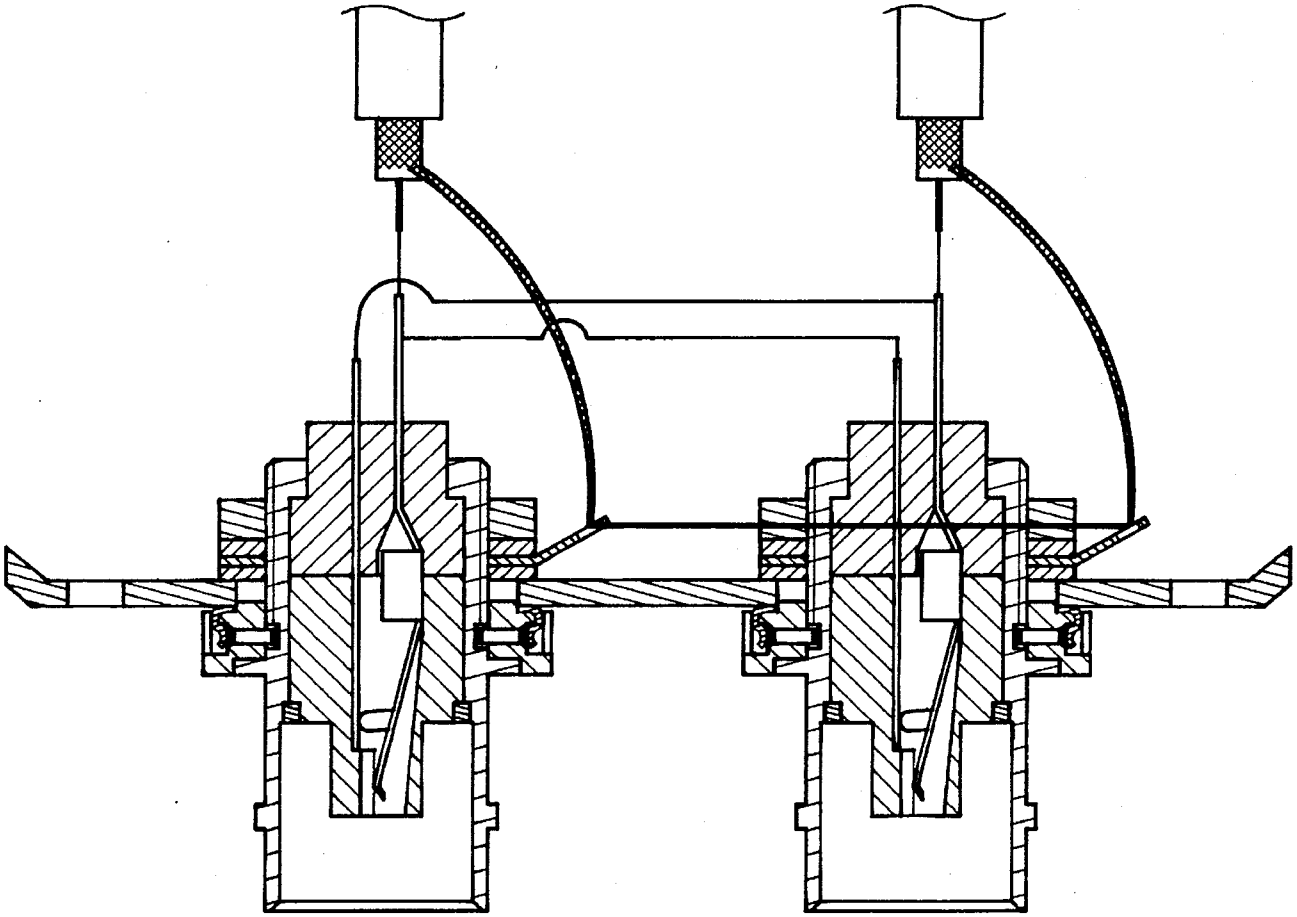
Fig. 1 PRIOR ART
FIG. 1 is a sectional view of a network coupler according to the prior art.
Figure 2:
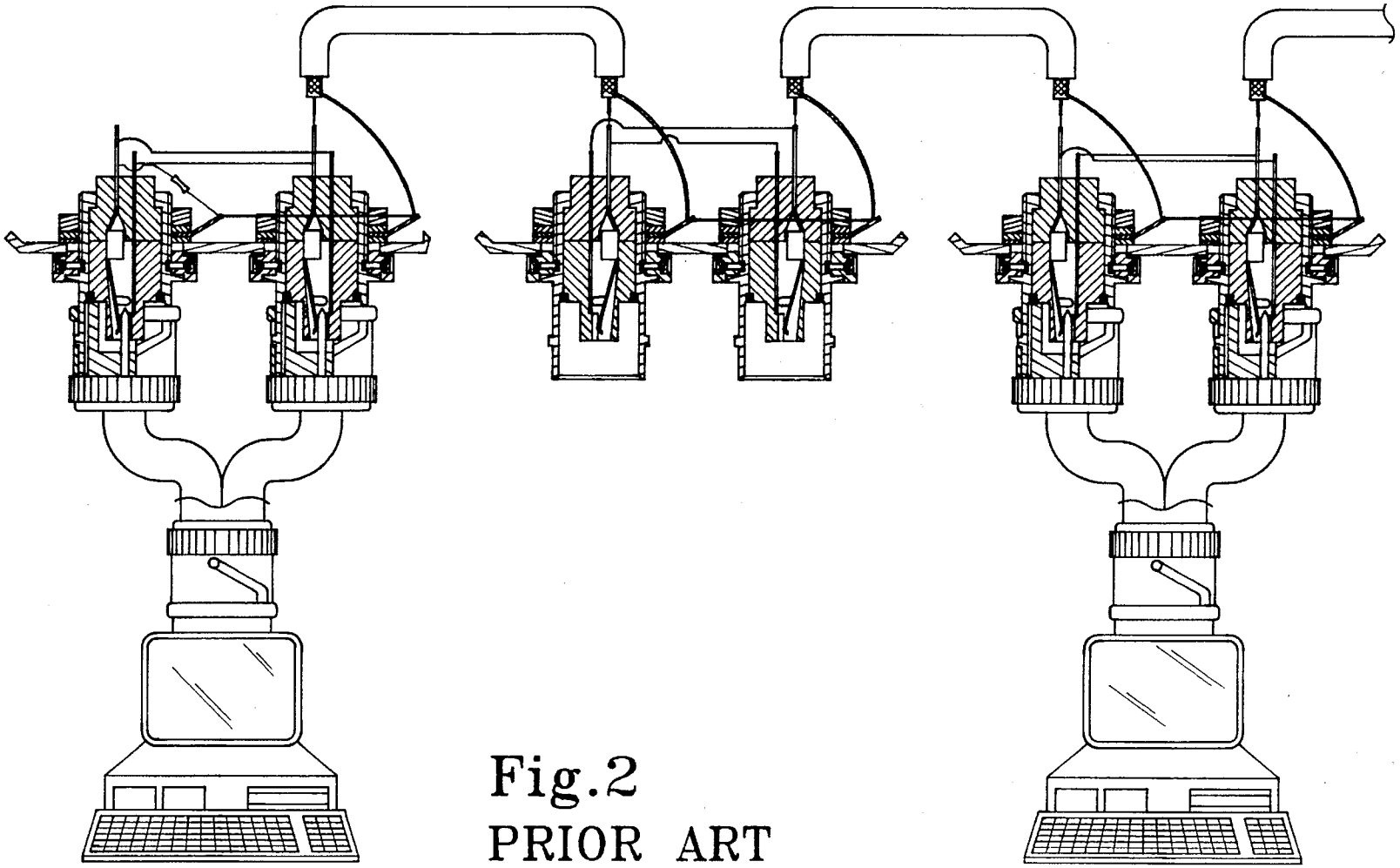
Fig.2 PRIOR ART
FIG. 2 shows the network coupler of FIG. 1 installed.
Figure 3:
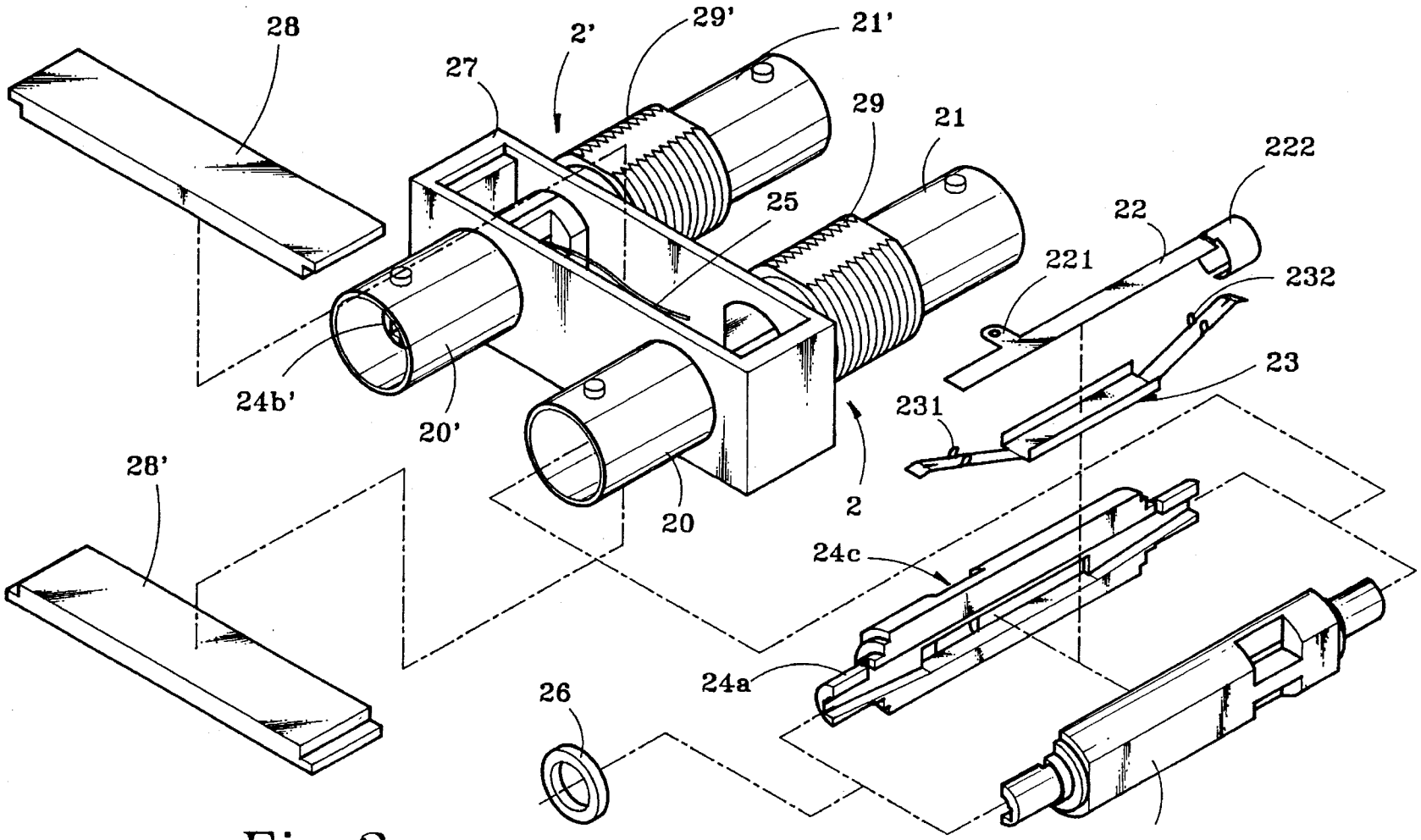
FIG. 3 shows the structure of a network coupler according to the present invention.

Referring to FIG. 3, the network coupler, referenced by 1, comprises two parallel, double-contact type coaxial cable connectors 2 and 2'. These coaxial cable connectors 2 and 2' are identical in structure. Therefore, only one coaxial cable connector 2 is explained in detail.

Figure 4B:
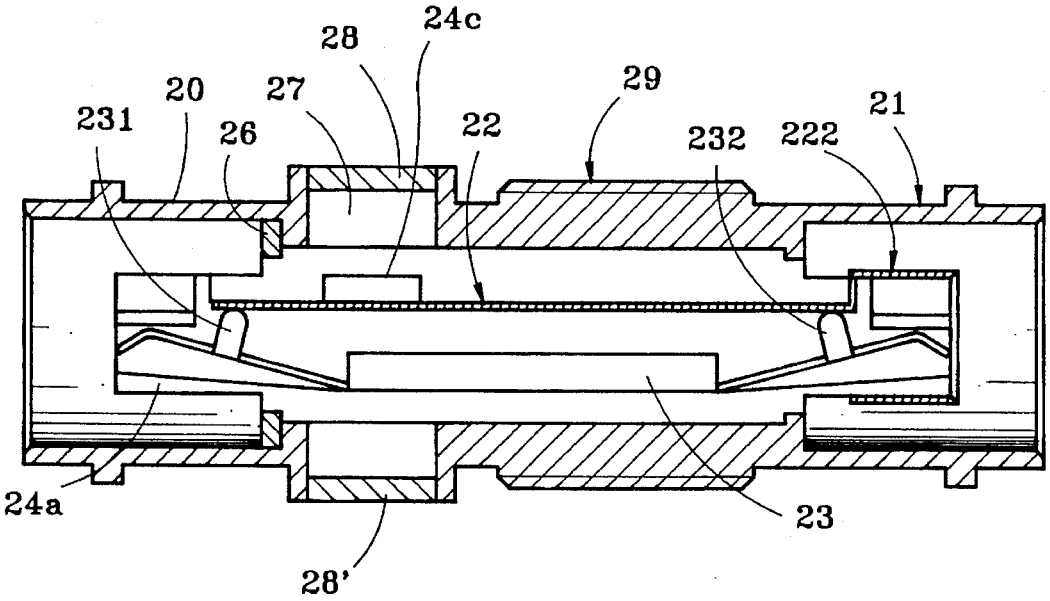
FIG. 4B is a sectional view taken along line 4B—4B of FIG. 4A.
Figure 6A:
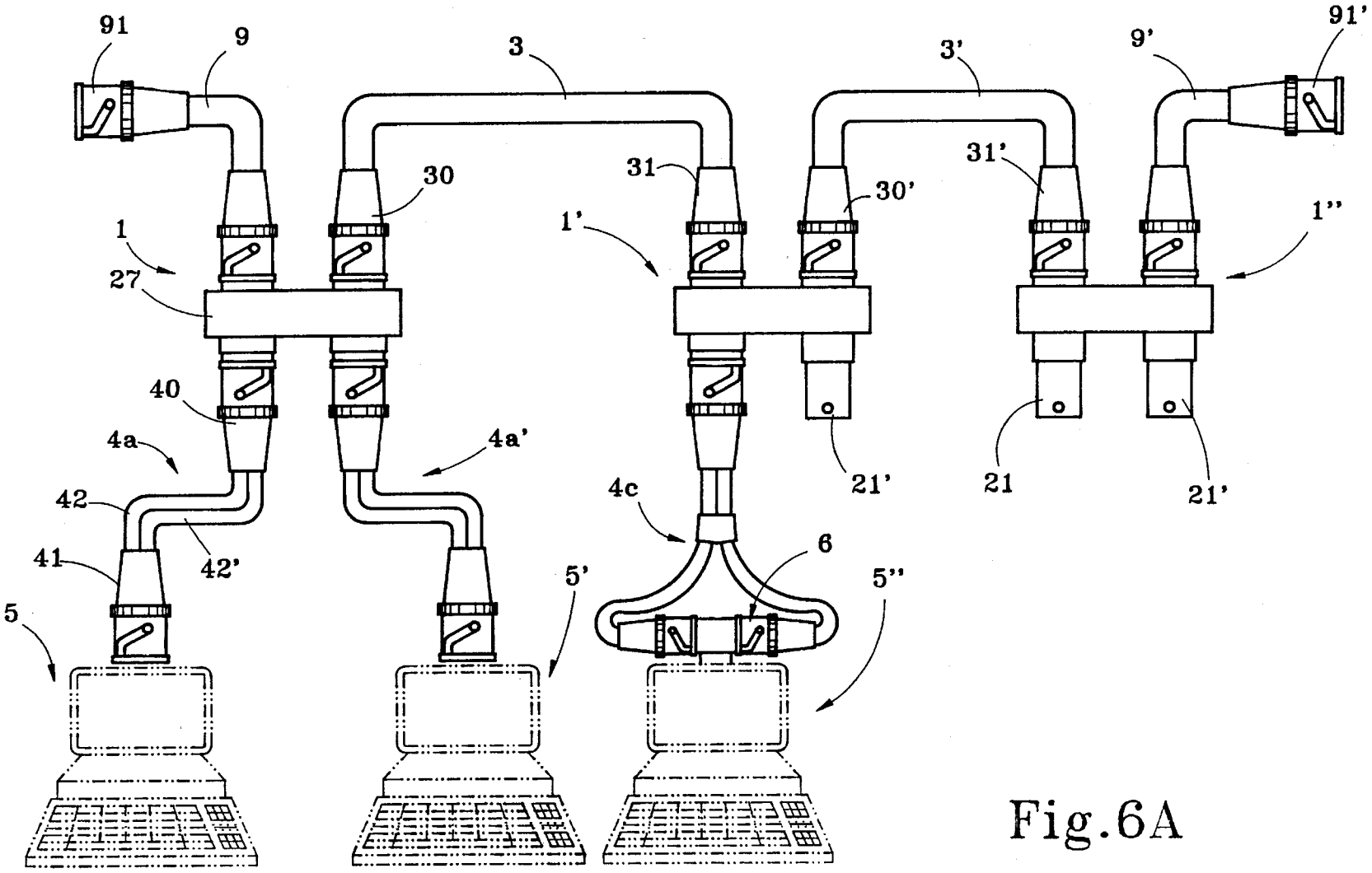
FIG. 6A is a computer network system chart showing the relative positions of the network couplers, dual cables, and personal computers.

Referring to FIG. 4B and FIG. 3 again, the coaxial cable connector 2 comprises a first BNC jack 20 at one end for connection to one BNC plug 30 or 31 of a network cable 3 (see FIG. 6A), and a second BNC jack 21 at an opposite end For connection to the BNC plug 40 of a dual cable 4, which is connected to a personal computer 5. As illustrated in FIG. 6A, the computer network comprises a plurality of network couplers 1 and 1' connected in series to a plurality of network cables 3 and 3'. One network coupler 1 can maximumly connect two personal computers 5 and 5'. The network couplers 1, 1', 1", etc. may be coupled to one or two personal computers 5, 5' or not coupled to any personal computers. However, any arrangement of the network couplers, 1, 1', 1", etc. does not affect signal transmission in the network cables 3 and 3'.

The coaxial cable connector 2 comprises a center contact 22, a side contact 23, and two insulators 24*a* and 24*b* respectively covered around the center contact 22 and the side contact 23. The side contact 23 comprises a first contact portion 231 disposed inside the first BNC jack 20, and a second contact portion 232 disposed inside the second BNC jack 21. The first and second contact portions 231 and 232 are normally disposed in contact with the center contact 22. When the first contact portion 231 of the side contact 23 is connected to one BNC plug 30 of one network cable 3, the center contact 301 of the BNC plug 30 forces the first contact portion 231 away from the center contact portion 22 (see FIG. 6B). The center contact 22 comprises a first projecting portion 221 at one end extended out of the insulators 24*a* and 24*b* through a through hole 24C and connected to the corresponding first projecting portion 221' of the coaxial cable connector 2' of the same network coupler 1 by a conductor 25 (see also FIG. 6B), a second projecting portion 222 shaped like a loop and extended out the insulators 24*a* and 24*b* and then mounted around the insulators 24*a* and 24*b* for connection to one BNC plug 40 of a dual cable 4 (this will be described further).

As illustrated in FIG. 3, a gasket 26 is installed in the coaxial cable connector 2 to hold down the insulators 24*a* and 24*b*. The two coaxial cable connectors 2 and 2' are mounted in an open frame 27. The aforesaid through hole 24*c* and first projecting portion 221 are disposed inside the open frame 27 convenient for the welding of the conductor 25. After installation, the open frame 27 is covered by cover boards 28 and 28'.

Figure 5A:
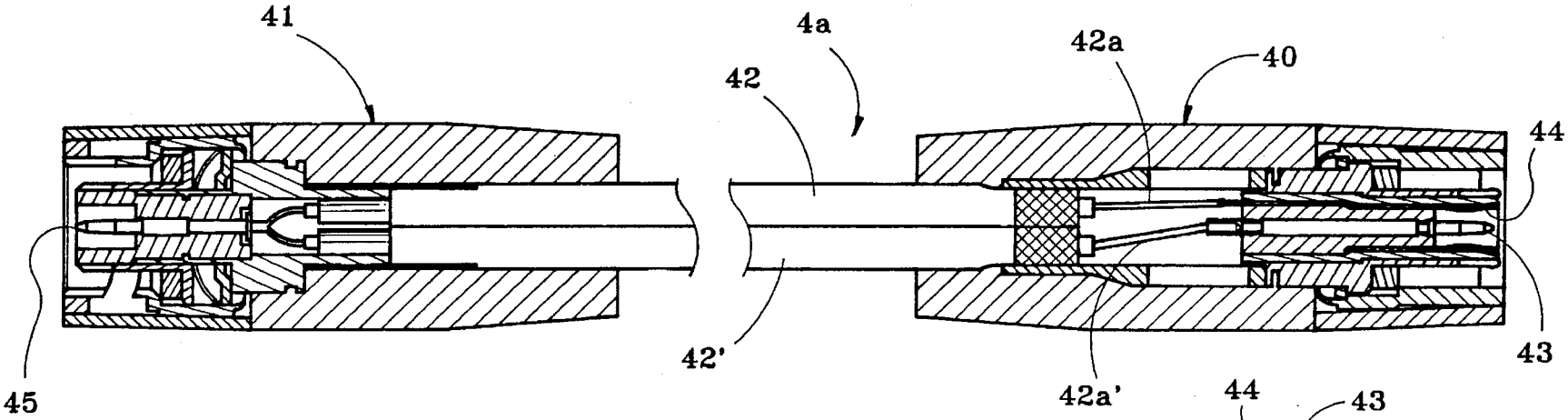
FIG. 5A is a sectional view of a dual cable according to the present invention.

Referring to FIG. 5A, the dual cable 4*a* comprises a first BNC plug 40, a second BNC plug 41, and two coaxial cables 42 and 42' connected between the first and second BNC plugs 40 and 41. The second BNC plug 41 is connected to a personal computer 5, having a center contact 45 connected to the conductors 42*a* and 42*a*' of the coaxial cables 42 and 42' for transmitting signal to the personal computer 5. The first BNC plug 40 is for connection to the BNC jack 21 or 21', having a center contact 43, which moves the aforesaid second contact portion 232 of the aforesaid side contact 23 away from the aforesaid center contact 22 when installed, and a tubular side contact 44, which covers around the aforesaid second projecting portion 222. The center contact 43 and the tubular side contact 44 are respectively connected to the conductors 42*a* and 42*a*'.

Figure 6D:
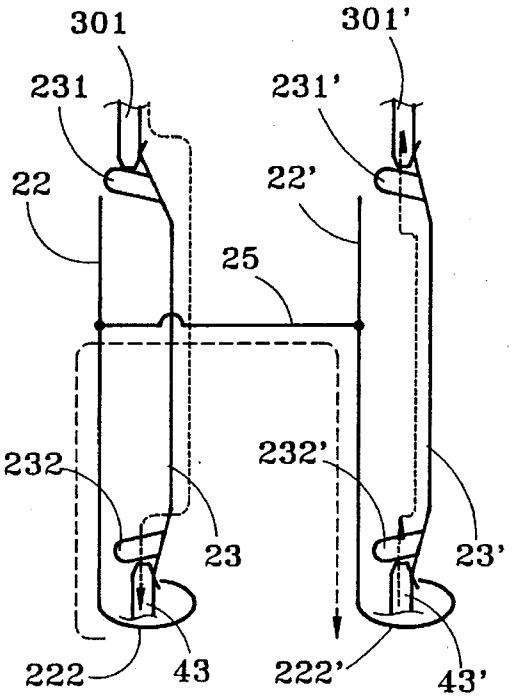
FIG. 6D shows the network signal transmitting route through a network coupler according to the present invention after the connection of two personal computers.
Figure 6C:
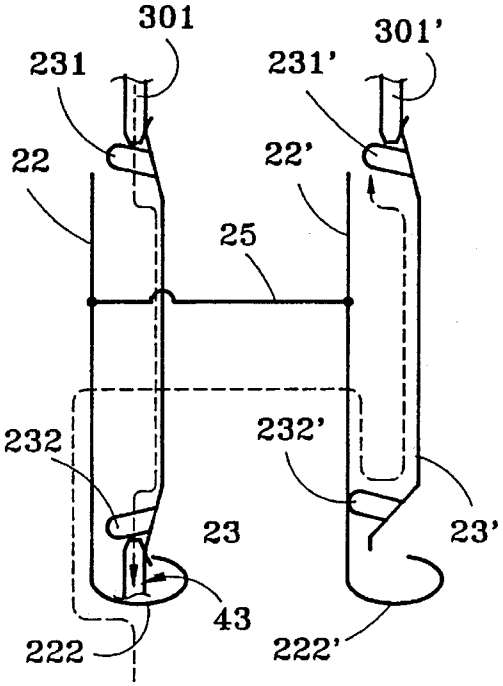
FIG. 6C shows the network signal transmitting route through a network coupler according to the present invention after the connection of one personal computer.
Figure 6B:
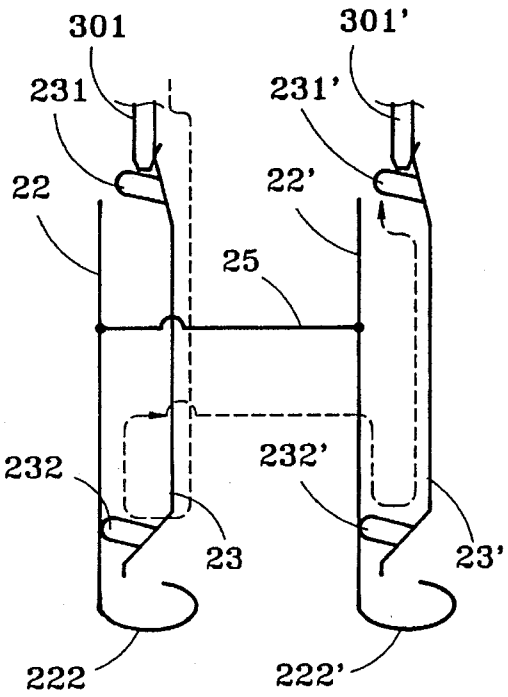
FIG. 6B snows the network signal transmitting route through a network coupler according to the present invention before the connection of personal computers.

The right-sided network coupler 1" shown in FIG. 6A is not directly connected to any personal computer, therefore network signal, as shown in FIG. 6B, is transmitted from the center contact 301 of the BNC plug 30 through the side contact 23, the second contact portion 232, the center contact 22, the conductor 25 the center contact 22', the second contact portion 232', the side contact 23', and the center contact 301', and then returned to the network cable 3.

The intermediate network coupler 1' shown in FIG. 6A is connected to a personal computer 5", therefore network signal, as shown in FIG. 6C, is transmitted in proper order through the side contact 23, the second contact portion 232, and the center contact 43 of the dual cable 4 to the computer 5", and feedback signal of the computer 5" is sent through the tubular side contact 44, the second projecting portion 222, the center contact 22, the conductor 25, the center contact 22', the second contact portion 232', the side contact 23' and the center contact 301' to the network cable 3. The left-sided network coupler 1 shown in FIG. 6A is connected to two personal computers 5 and 5', therefore signal is transmitted through the route indicated by the dotted line shown in FIG. 6D.

Figure 5B:
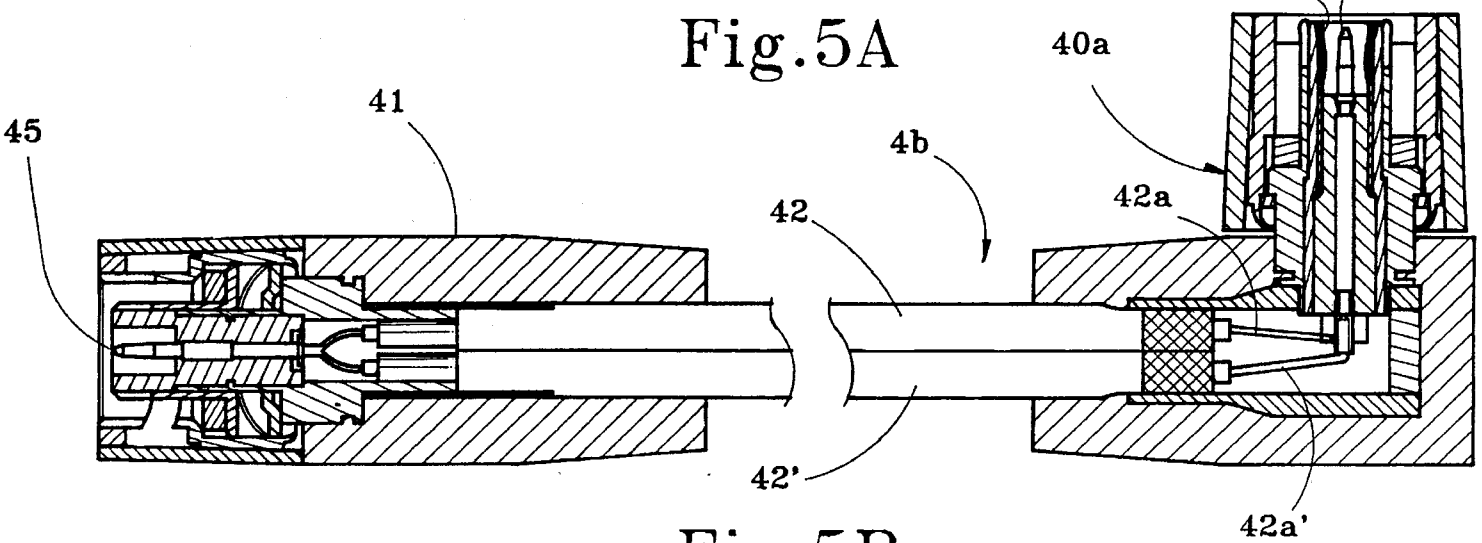
FIG. 5B shows an alternate form of the dual cable of the present invention.
Figure 5C:
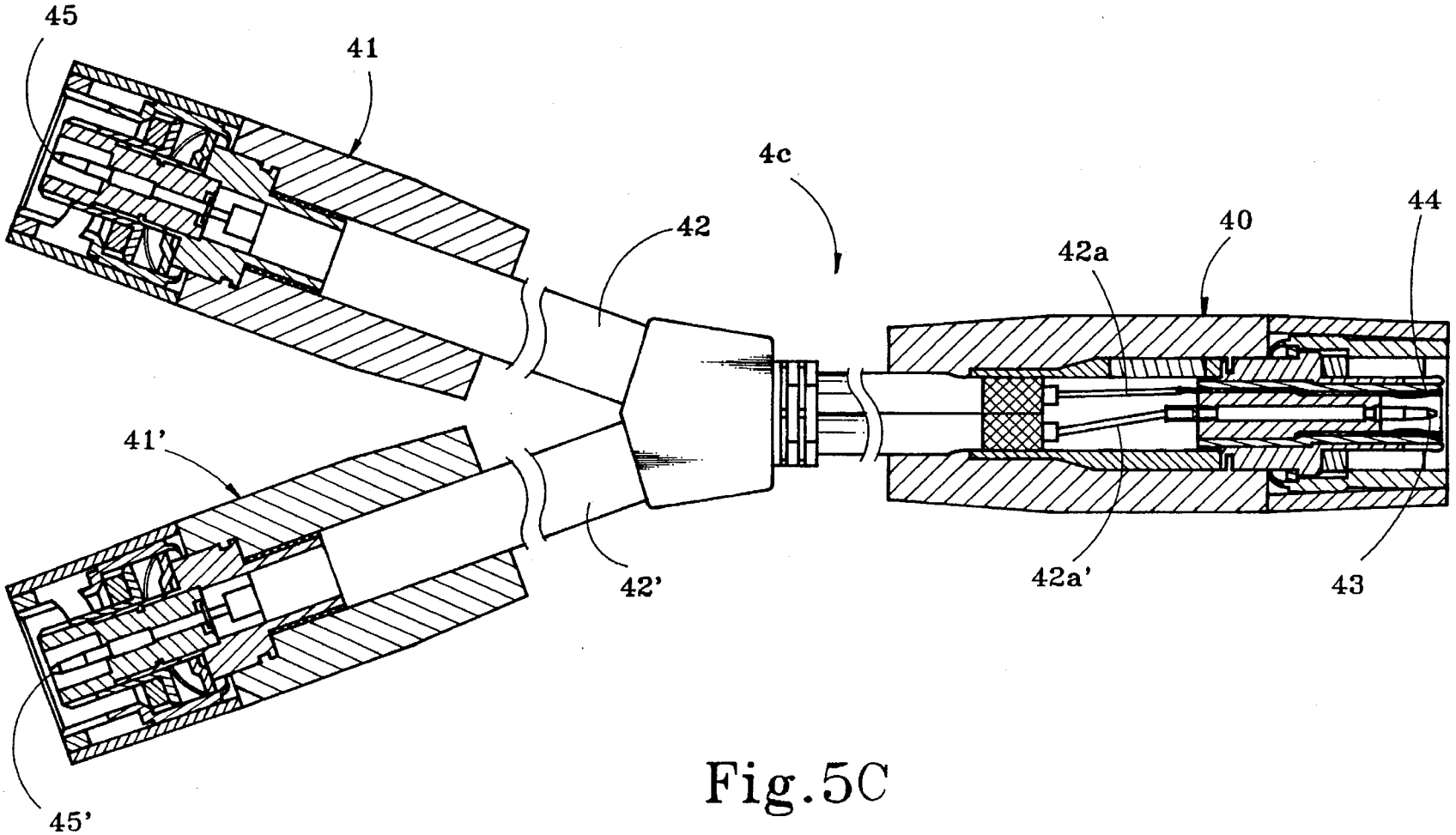
FIG. 5C shows another alternate form of the dual cable of the present invention.
Figure 5D:
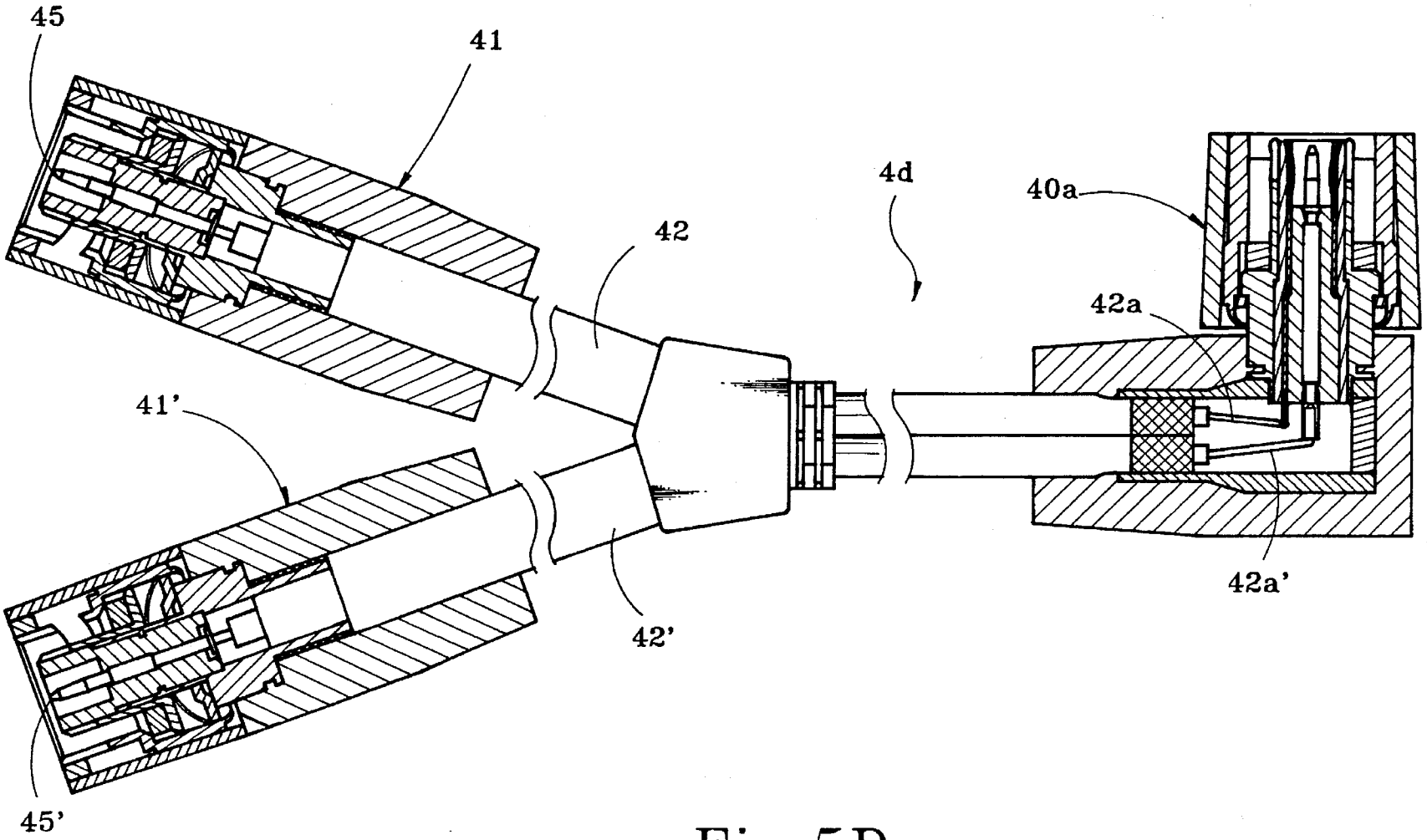
FIG. 5D shows still another alternate form of the dud 1 cable of the present invention.

FIG. 5B shows an alternate form of the dual cable according to the present invention. The first BNC plug 40*a* of the dual cable 4*b* shown in FIG. 5B has an angled configuration. FIG. 5C shows another alternate form of the dual cable according to the present invention. The conductors 42 and 42' of the dual cable 4*c* shown in FIG. 5C are respectively coupled with a respective BNC plug 41 or 41', therefore the dual cable 4*c* can be connected to a personal computer 5" through a T-type (or Y-type) BNC connector 6 (see FIG. 6A). FIG. 5D shows still another alternate form of the dual cable of the present invention. FIG. 5D shows still another alternate form of the dual cable according to the present invention, in which the BNC plug 40*a* has an angled configuration.

Figure 7:
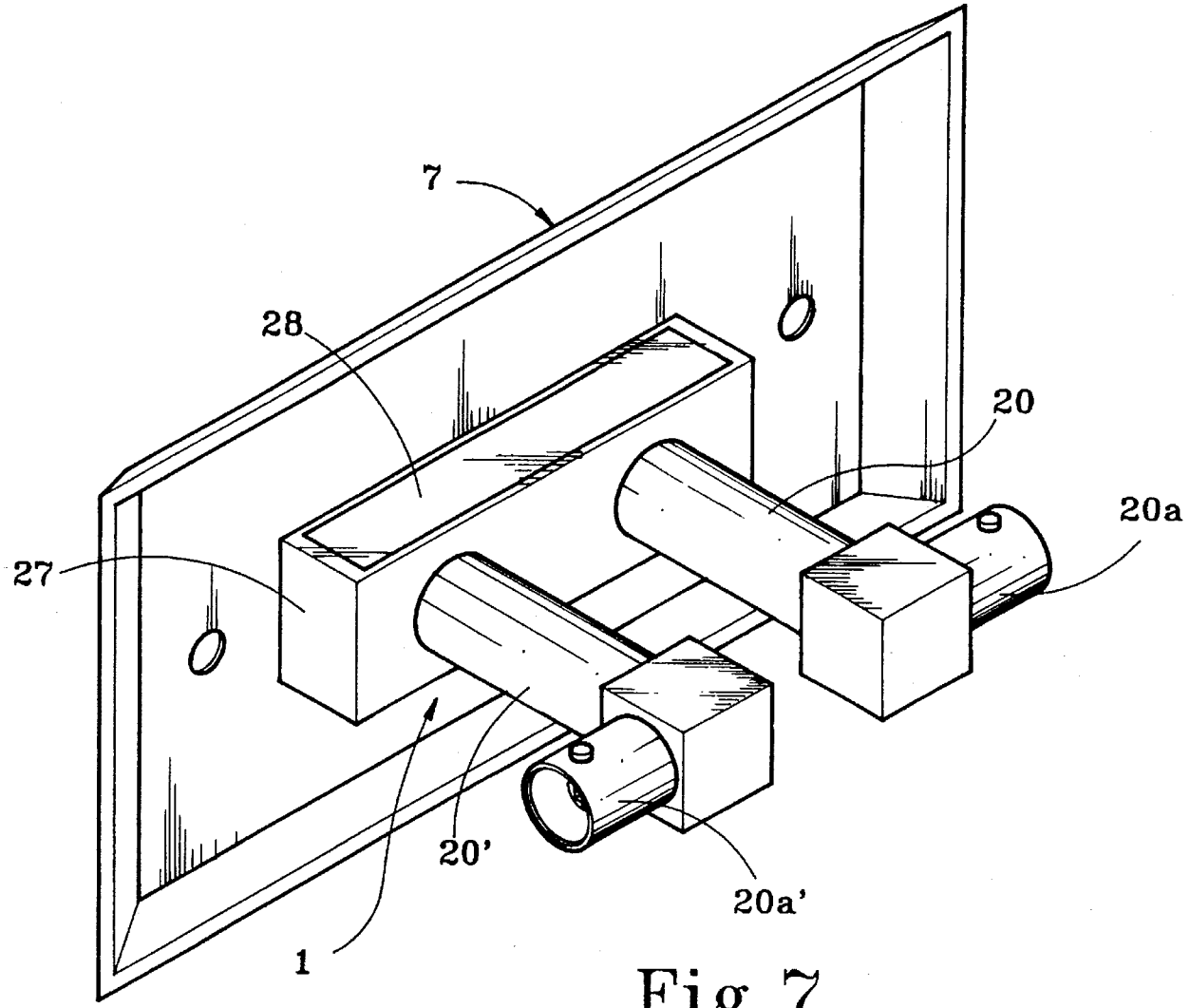
FIG. 7 shows the network coupler installed in a mounting board according to the present invention.
Figure 8:
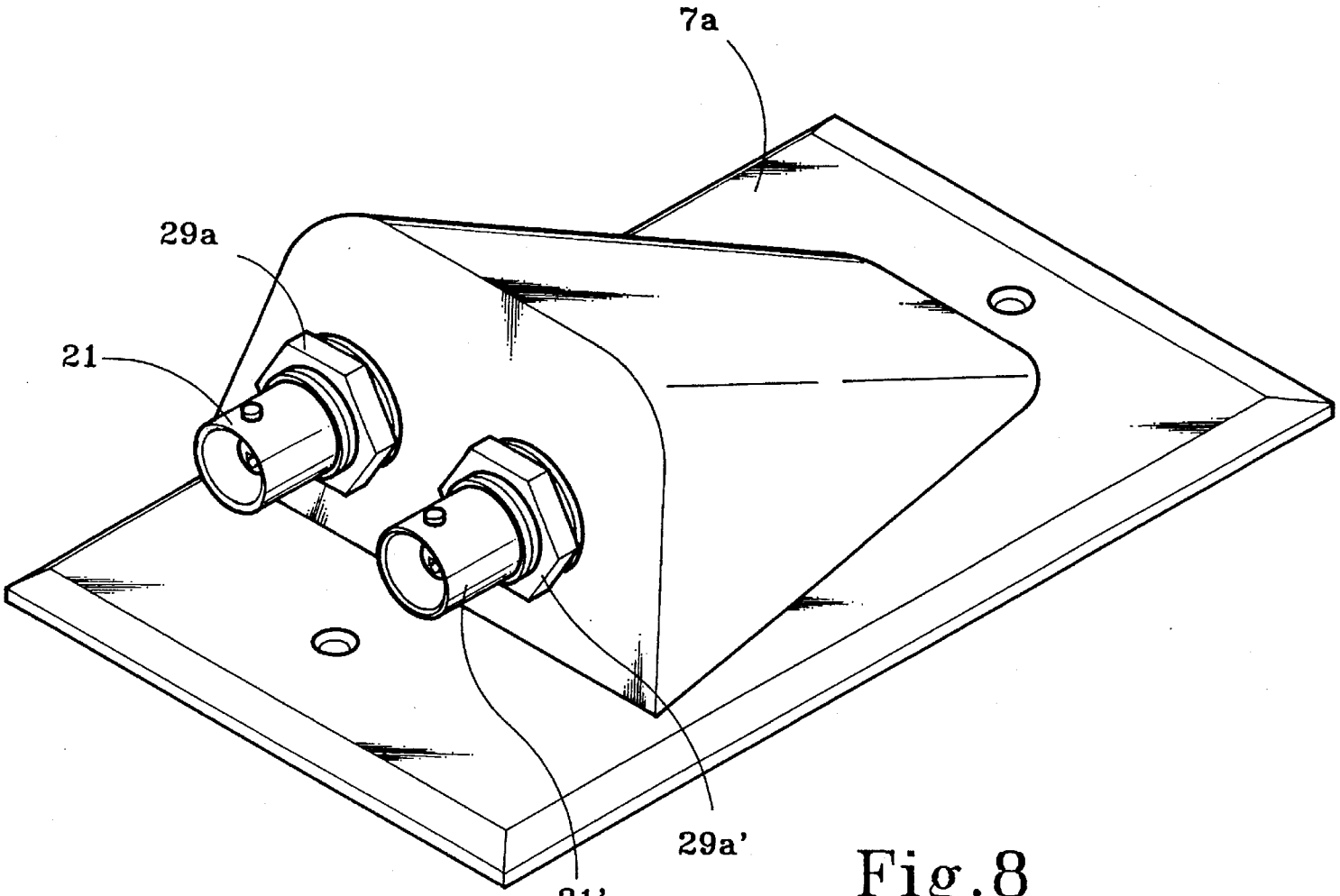
FIG. 8 shows the network coupler installed in another structure of mounting board according to the present invention.

FIG. 7 shows a network coupler 1 mounted on a wall mounting board 7, which can be fixed to the wall or floor of a building. The BNC jacks 20 and 20' have angled shells 20*a* and 20*a*' turned in the reversed directions for embedding in the wall of the building to connect the network cables. FIG. 8 shows an alternate form of the wall mounting board 7*a*.

Figure 4A:
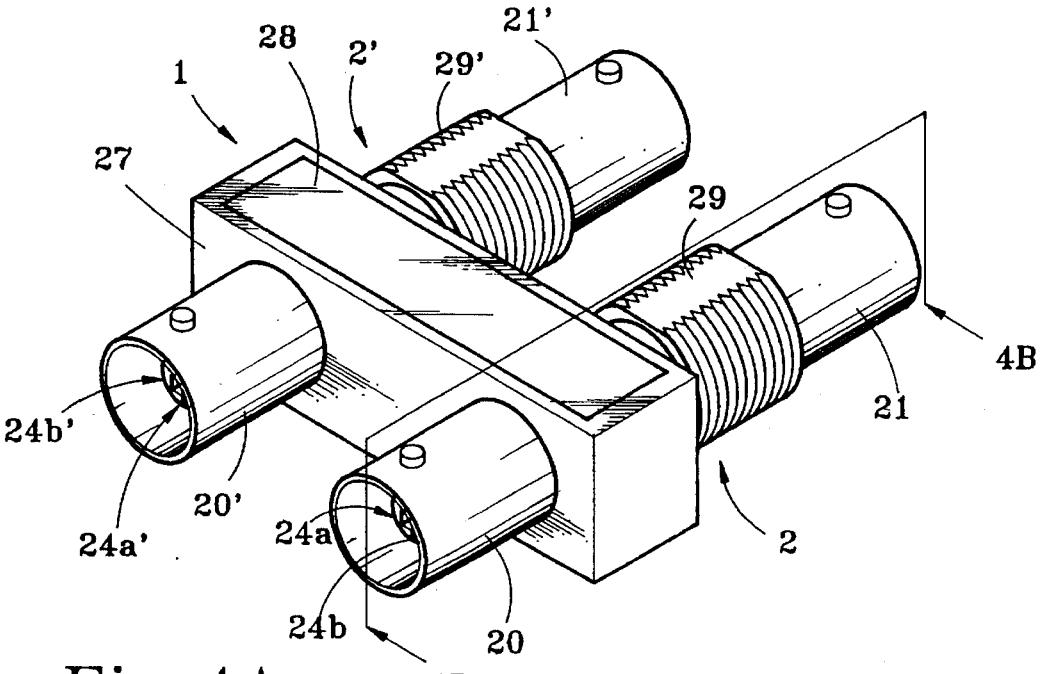
FIG. 4A is an elevational view of a network coupler according to the present invention.
Figure 9B:
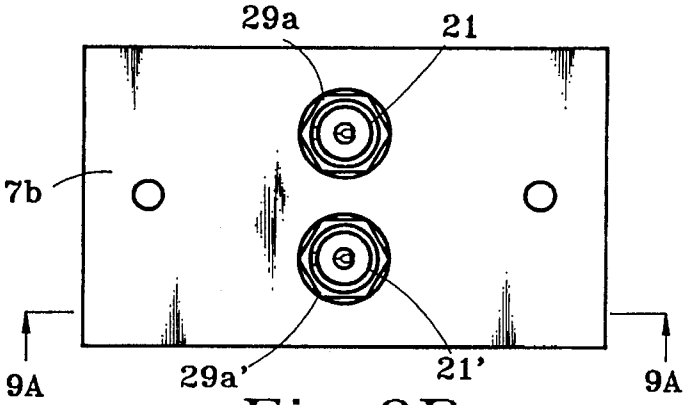
FIG. 9B is a top view of FIG. 9A.
Figure 9A:
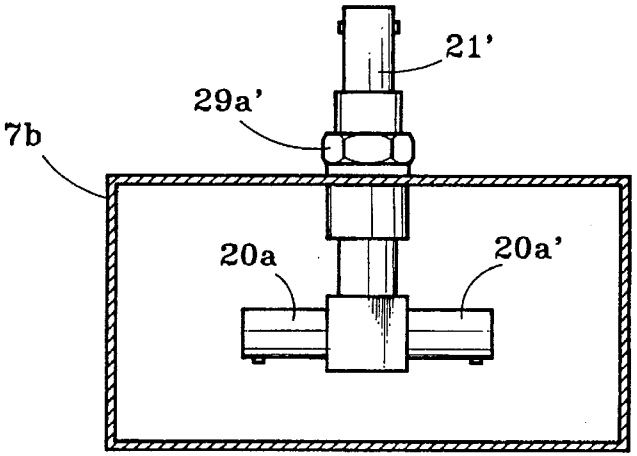
FIG. 9A shows the network coupler installed in a rectangular mounting box according to the present invention.
Figure 10B:
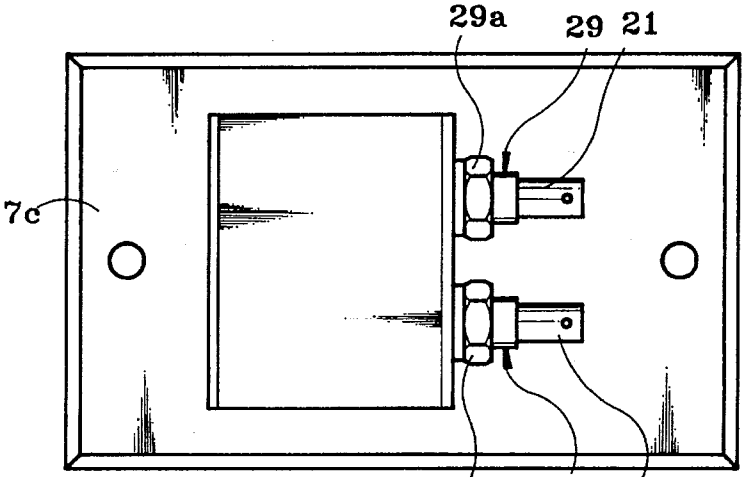
FIG. 10B is a top view of FIG. 10A.
Figure 10A:
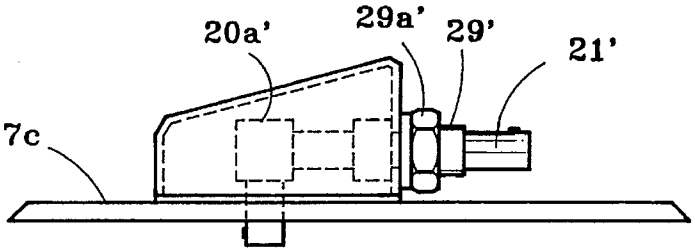
FIG. 10A shows the network coupler installed in another structure of mounting box according to the present invention.

FIGS. 9A and 9B show a network coupler 1 mounted within a rectangular mounting box 7*b*. The rectangular mounting box 7*b* is designed to be embedded in the wall or floor of a building. FIGS. 10A and 10B show another structure of network coupler mounting box 7*c*. As illustrated in FIGS. 9A and 10, the network coupler 1 is fastened to the mounting box 7*b* or 7*c* by the outer thread portions 29 and 29' of the coupler 1 itself (see also FIG. 4A) and external screw nuts 29*a* and 29*a*'.

Figure 11:
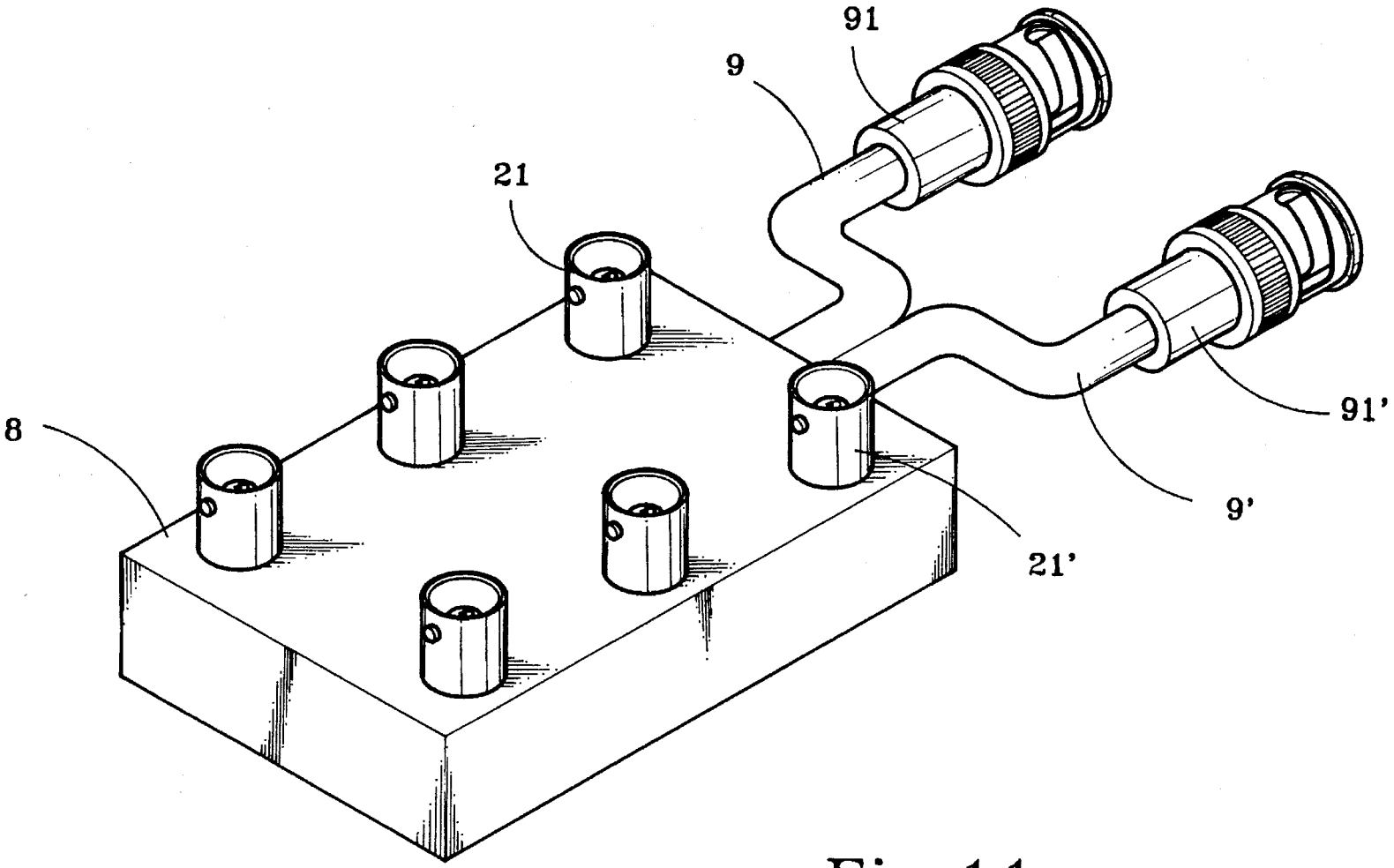
FIG. 11 is an elevational view of a network junction box according to the present invention.

Referring to FIG. 11, a network junction box 8 is provided having a plurality of network couplers on the inside (not shown). The BNC jacks 21 and 21' of the network couplers extend out of the network junction box 8. The network junction box 8 has two network cables 9 and 9' at one end respectively coupled with a respective BNC plug 91 or 91' for connection to one network coupler being fixedly mounted in a computer network system. By means of the network junction box 8, additional sets of personal computers can be linked to the computer network system being fixedly installed in a building. Therefore, personal computers can be connected to the computer network system in a building at desired locations.

It is to be understood that a network coupler of the present invention can be connected to two personal computers only when a dual cable is used.

I claim:

1. A computer network distribution system comprising:

a plurality of network couplers, each network coupler comprising a first coaxial cable connector and a second coaxial cable connector, said first and second coaxial cable connectors each comprising a side contact connected to a cable network and a center contact disposed in contact with the side contact, the center contacts of said first and second coaxial cable connectors of one network coupler being connected by a conductor permitting a signal of a cable network to be transmitted from the side contact of said first coaxial cable connector, the center contact of said first coaxial cable connector, the conductor between the center contacts of said first and second coaxial cable connectors, the center contact of said second coaxial cable connector and the side contact of said second coaxial cable connector, and then sent back to the cable network for transmission to another network coupler, the center contact of one coaxial cable connector having a loop-like projecting portion spaced from the corresponding side contact for connection to one BNC plug of a dual cable; and a plurality of dual cables for connecting said network couplers to personal computers, each dual cable comprising a first BNC plug for connection to a personal computer, a second BNC plug for connection to one coaxial cable connector of one network coupler, and two coaxial cables connected between said first and second BNC plugs, said first BNC jack having a center contact, which when connected to one coaxial cable connector of one network coupler, moves the side contact of the coaxial cable connector away from the center contact of the coaxial cable connector, and a tubular side contact, which when connected to one coaxial cable connector of one network coupler, covers around the loop-like projecting portion of the center contact of the coaxial cable connector.

2. The computer network distribution system of claim 1 further comprising a plurality of network junction boxes, each network junction box comprising a plurality of network couplers for connecting personal computers to a computer network system.

* * * * *